US005544511A

United States Patent [19]

Cavaleri

[11] Patent Number: 5,544,511

[45] Date of Patent: Aug. 13, 1996

[54] OPENABLE RING WITH A LOCKING MEANS

[76] Inventor: Joseph Cavaleri, 39, route de Vevey, CH - 1009 Pully, Switzerland

[21] Appl. No.: 324,878

[22] Filed: Oct. 18, 1994

[30] Foreign Application Priority Data

Oct. 19, 1993 [CH] Switzerland ..... 3144/93

[51] Int. Cl.[6] ..... A44B 15/00

[52] U.S. Cl. ..... 70/457; 63/15.65; 70/459

[58] Field of Search ..... 70/456 R, 457, 70/458, 459, 460; 24/598.2; 63/15.7, 15.65, 15.5, 9; D3/207–210

[56] References Cited

U.S. PATENT DOCUMENTS

| | | | |
|---|---|---|---|
| 725,322 | 4/1903 | Davis | 63/9 |
| 1,209,083 | 12/1916 | Wagner, Jr. | 24/598.2 X |
| 2,771,753 | 11/1956 | Sallan | 63/9 |
| 3,423,956 | 1/1969 | Manne | 63/15.65 |

FOREIGN PATENT DOCUMENTS

| | | | |
|---|---|---|---|
| 1093949 | 5/1955 | France | 70/459 |
| 1411764 | 7/1964 | France | 70/459 |
| 2920327 | 11/1980 | Germany | 70/456 R |
| 92765 | 2/1922 | Switzerland | 63/9 |

*Primary Examiner*—Lloyd A. Gall
*Attorney, Agent, or Firm*—Clifford W. Browning; Woodard, Emhardt, Naughton Moriarty & McNett

[57] ABSTRACT

The ring is composed of three arc of a circle-like portions which are hinged connected between them so as to allow their mutual pivoting movement in the plane of the ring. The first portion (1) extends on an arc of about 270° and each one of the two other portions extend on an arc of about 45°, providing a full ring. Male locking member (9) and female locking member (10) allow to close the ring between the first portion (1) and the third portion (5). To open the ring, it is enough to push inwardly the hinged connection (7) between the second and third portions (4, 5) of the ring, against the resilient force exerted by the first portion (1). The closure of the ring takes place in engaging the male locking member (9) into the female member (10) and by displacing outwardly the hinged connection (7) also against the resilient force of the first portion (1). Once the ring is closed, it is no longer possible to cause its opening under the action of an outwardly directed force.

3 Claims, 2 Drawing Sheets

OPENABLE RING WITH A LOCKING MEANS

The present invention is concerned with an openable ring provided with a locking means, such as can be used for example as a key-ring, as a jewelry item or as a link member for technical applications.

BACKGROUND OF THE INVENTION

The openable rings known up to now all have the drawbacks of either being difficult to open and to close while sometimes even requiring a tool, or of not providing an adequate safety against an involuntary opening, or of not having an overall aesthetically pleasing and practical shape.

SUMMARY OF THE INVENTION

The present invention is aimed at providing a ring which can be easily opened or closed, without any tool, by simply pressing or pulling at a certain location of its periphery, while offering a high level of safety against an inadvertent opening. Furthermore, the invention is aimed at providing a ring which is smooth without any portions by which the ring could get caught and which would affect the aesthetic simplicity of the annular shape.

To this end, the ring according to the invention includes a first ring portion extending between its ends over an angle of 180° to 300°, a second and a third ring portion extending each one over an angle of 30° to 150° between their respective ends, in such a manner as to provide, in the closed state, a full ring, a first end of said first portion and a first end of said second ring portion including a first hinged connection, the second end of said second ring portion and a first end of said third ring portion including a second hinged connection, said hinged connections allowing a pivoting movement in the plane of the ring, and the second ends of said first and third ring portions including a male locking member and a female locking member arranged in such a manner as to allow a disengagement of these members and hence an opening of the ring when said second hinged connection is moved inwards of the ring against the resilient force of said first ring portion thereof and in such a manner as not to allow a disengagement of these members when an outwardly directed force is exerted on the closed ring.

Another object of the invention is the use of such a ring as a key-ring, while however not being limited to such a specific use.

BRIEF DESCRIPTION OF THE DRAWING FIGURES

The invention will be better understood from the description given hereafter of an exemplary embodiment illustrated in the appended drawing, wherein.

DETAILED DESCRIPTION OF THE PREFERRED EMBODIMENT

Figure 1:
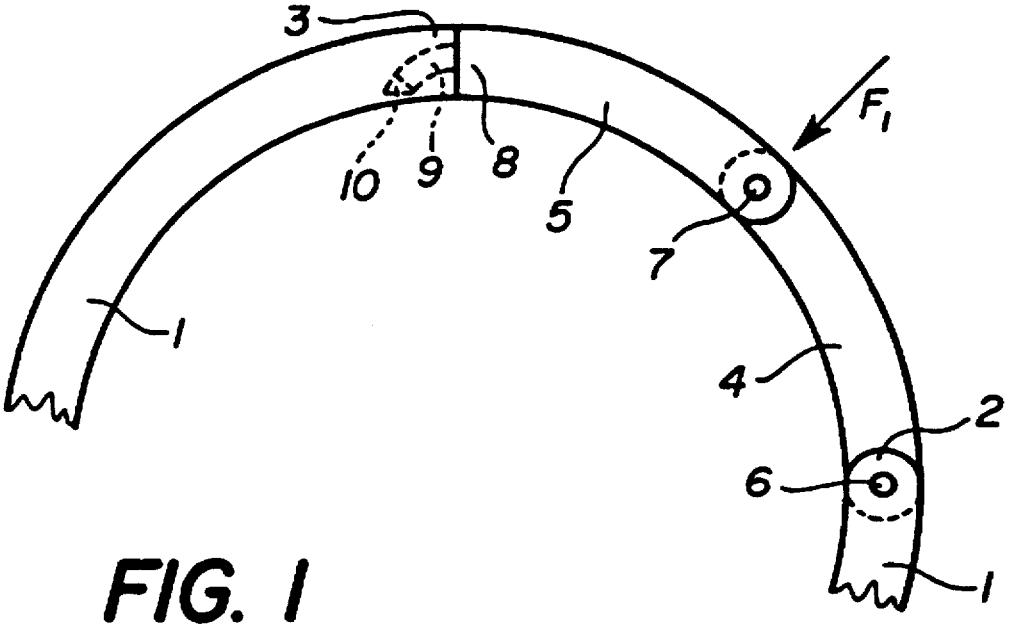
FIG. 1 shows a ring according to the invention, in its closed state.
Figure 2:
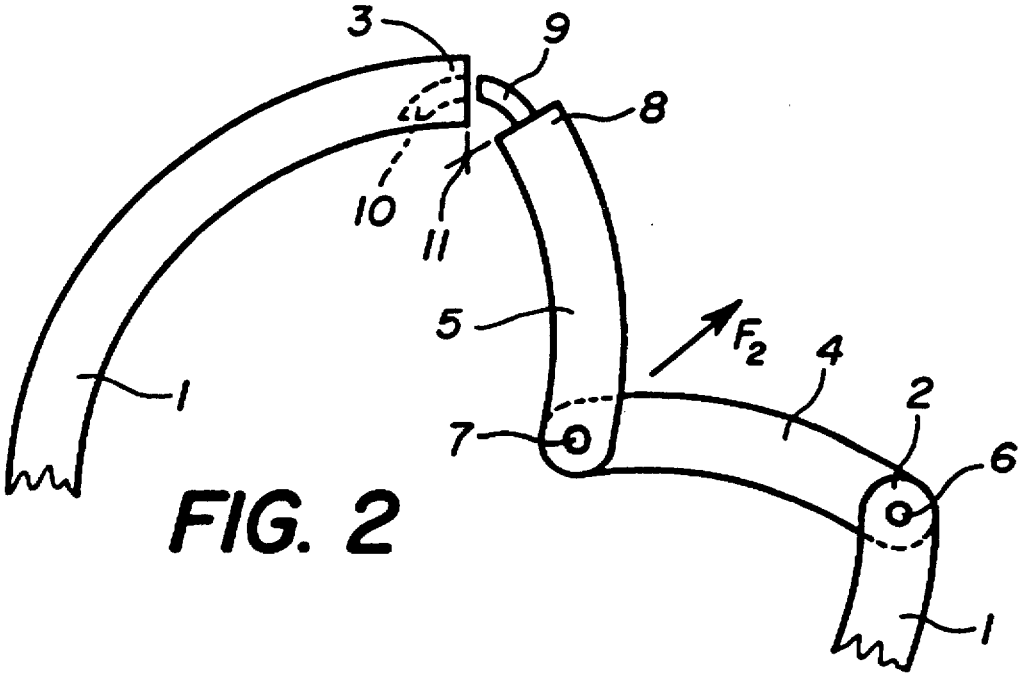
FIG. 2 shows the ring of FIG. 1 at an intermediate state between the fully open and the closed positions.
Figure 3:
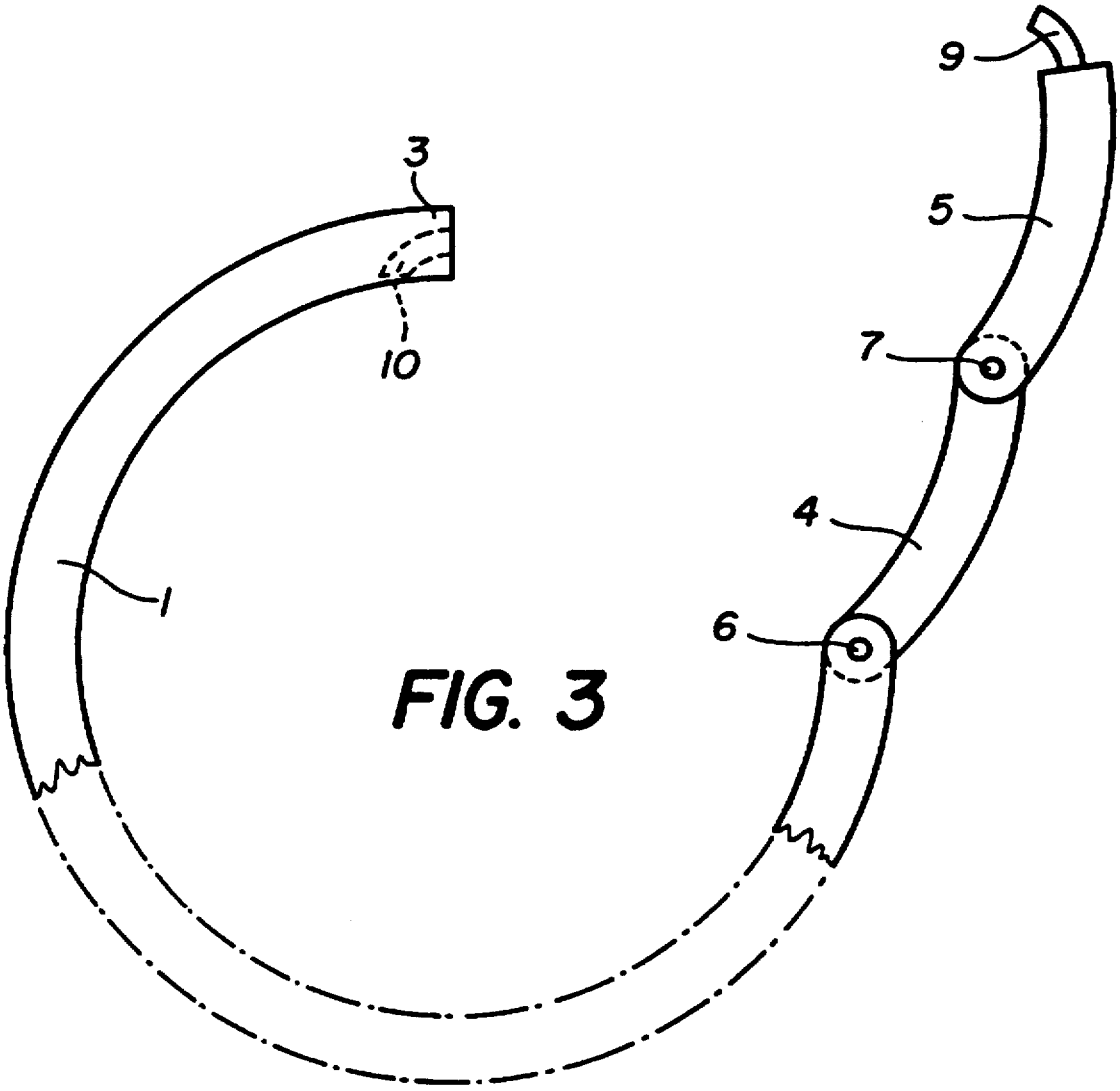
FIG. 3 shows the same ring, fully open.

The ring shown in FIGS. 1 to 3 includes a first ring portion 1 which extends over about 270° between its ends 2 and 3, with the drawing showing only the sections close to these ends. A second and a third ring portion in the form of segments, designated respectively by numerals 4 and 5, extend each one over about 45° and are hingedly connected at 6 and 7, in such a manner as to be able to pivot about the corresponding pivots.

As shown in FIG. 2, the end 8 of the ring portion 5 is provided with a curved hook-shaped protrusion 9 arranged so that it can engage into a matching recess 10 provided in the free end 3 of portion 1. To this end, the protrusion 9 and the recess 10 have similar transverse cross-sections, for example of a circular or a rectangular shape, and they have the same radius of curvature and the same center of curvature 11. This construction enables the disengagement and the engagement of these male 9 and female 10 members through a rotational movement in the plane of the ring around an axis extending through 11, perpendicularly to this plane. It is to be noted that only this rotational movement makes possible the above-mentioned engagement and the disengagement. The center of curvature 11 of the members 9 and 10 around which the rotational movement of these members takes place, is preferably located at the intersection of the contact surfaces of the ends 3 and 8 of the ring portions 1 and 5. Preferably, the center 11 is located in the vicinity of the inner edge of these ends or on the same. However, other constructions are possible for the contact surface of the ends 3 and 8, as well as other shapes for the male and female locking members. These members must however satisfy the requirement that solely a movement of the portion 5 directed inwards of the ring be possible when the ends 3 and 8 come or are in contact.

The opening of the ring from the closed position of FIG. 1 is achieved by a pressure of the hinged connection at the pivot 7 in the direction of arrow Fl. The displacement of the pivot 7 in the radial direction of the ring causes a pivoting of the parts 4 and 5 around, respectively, the pivot 6 and the center of curvature 11 until the disengagement of the protrusion 9. Similarly, upon closure of the ring, the protrusion 9 is engaged in the recess 10 and the pivot 7 is pressed or pulled outwards with respect to the ring in the radial direction thereof, as indicated by arrow F2 of FIG. 2. The displacement of the pivot 7 in the radial direction of the ring necessitates, in both directions of movement, i.e. inwards with respect to the ring for opening it as indicated by arrow F1 or in the direction of arrow F2 to achieve the closed position of FIG. 1, that the ends 2 and 3 of the first ring portion 1 move apart. This portion which is made for example of brass like the remainder of the ring, exhibits, owing to its shape and the material used, a resiliency which can be adapted to the desirable force required for opening or closing the ring.

FIG. 3 shows the ring in a fully open position, which makes it possible to place or remove from the ring items having an appropriate opening, such as keys.

Various alternate embodiments of the ring with a closing means as described above can be envisaged within the scope of the invention. It should be noted that in the closed shape of the ring, no portion of the closure protrudes from the outer periphery of the ring and that the hinged connections at the pivots 6 and 7 can of course be made in such a manner as to produce a smooth ring of a simple shape, as is generally desirable.

I claim:

1. An openable key-ring provided with locking means, including a first ring portion extending between its ends over an angle of 180° to 300°, a second and third ring portion extending each over an angle of 30° to 150° between their respective ends, in such a manner as to provide, in the closed state, a full ring, a first end of said first ring portion and a first end of said second ring portion including a first hinged connection, the second end of said second ring portion and a first end of said third ring portion including a second hinged connection, said hinged connections allowing a pivoting movement in the plane of the ring, and the second ends of said first and third ring portions including a male locking member and a female locking member, said locking members being formed, respectively, as a non-linear protrusion curved along its longitudinal extent and as a hollow of a similar cross-section having the same radius and the same center of curvature as the protrusion, the arrangement of said locking members allowing a disengagement thereof and hence an opening of the ring when said second hinged connection is moved inwards of the ring against a resilient force of said first ring portion thereof, and preventing a disengagement of said locking members when an outwardly directed force is exerted on the closed ring.

2. An openable ring provided with locking means, including first ring portion extending between its ends over an angle of 180° to 300° , a second and third ring portion extending each over an angle of 30° to 150° between their respective ends, in such a manner as to provide, in the closed state, a full ring, a first end of said first ring portion and a first end of said second ring portion including a first hinged connection, the second end of said second ring portion and a first end of said third ring portion including a second hinged connection, said hinged connections allowing a pivoting movement in the plane of the ring, and the second ends of said first and third ring portions including a male locking member and a female locking member, said locking members being formed, respectively, as a non-linear protrusion curved along its longitudinal extent and as a hollow of a similar cross-section having the same radius and the same center of curvature as the protrusion, the arrangement of said locking members allowing a disengagement thereof and hence an opening of the ring when said second hinged connection is moved inwards of the ring against a resilient force of said first ring portion thereof, and preventing a disengagement of said locking members when an outwardly directed force is exerted on the closed ring.

3. A ring according to claim 2 characterized in that the first ring portion extends substantially over 270° , and each one of the two other ring portions extent over substantially 45°.

* * * * *

UNITED STATES PATENT AND TRADEMARK OFFICE

CERTIFICATE OF CORRECTION

PATENT NO. : 5,544,511
DATED : August 13, 1996
INVENTOR(S) : Joseph Cavaleri

It is certified that error appears in the above-indentified patent and that said Letters Patent is hereby corrected as shown below:

In column 2, line 24, please delete "edge" and insert in lieu thereof --edges--.

In column 3, line 20, please insert --a-- before "first".

In column 4, line 21, pleae delete "extent" and insert in lieu thereof --extend--.

Signed and Sealed this

Twenty-first Day of October 1997

*Attest:*

*Attesting Officer*

BRUCE LEHMAN

*Commissioner of Patents and Trademarks*